US010323315B2

(12) United States Patent
Katsumata et al.

(10) Patent No.: US 10,323,315 B2
(45) Date of Patent: Jun. 18, 2019

(54) CARBURIZING DEVICE

(71) Applicants: IHI Corporation, Tokyo (JP); IHI Machinery and Furnace Co., Ltd., Tokyo (JP)

(72) Inventors: Kazuhiko Katsumata, Inuyama (JP); Masatoshi Mitsuzuka, Kakamigahara (JP); Osamu Sakamoto, Kamo-gun (JP); Takahiro Nagata, Kamo-gun (JP)

(73) Assignees: IHI CORPORATION, Tokyo (JP); IHI MACHINERY AND FURNACE CO., LTD., Tokyo (JP)

( * ) Notice: Subject to any disclaimer, the term of this patent is extended or adjusted under 35 U.S.C. 154(b) by 159 days.

(21) Appl. No.: 15/288,877

(22) Filed: Oct. 7, 2016

(65) Prior Publication Data

US 2017/0022596 A1 Jan. 26, 2017

Related U.S. Application Data

(63) Continuation of application No. PCT/JP2015/068983, filed on Jul. 1, 2015.

(30) Foreign Application Priority Data

Jul. 23, 2014 (JP) ..... 2014-149915

(51) Int. Cl.
*F27D 25/00* (2010.01)
*C23C 8/20* (2006.01)
(Continued)

(52) U.S. Cl.
CPC ..... *C23C 8/20* (2013.01); *C21D 9/0006* (2013.01); *F27B 5/04* (2013.01); *F27B 5/06* (2013.01); *F27B 5/14* (2013.01); *F27D 7/04* (2013.01); *F27D 7/06* (2013.01); *F27D 25/008* (2013.01); *C21D 1/06* (2013.01)

(58) Field of Classification Search
CPC ..... F27D 7/06; F27D 25/008
See application file for complete search history.

(56) References Cited

U.S. PATENT DOCUMENTS 4,135,053 A 1/1979 Kastilahn et al.
5,168,014 A 12/1992 Daimaru et al.
(Continued)

FOREIGN PATENT DOCUMENTS

CN 1394982 A 2/2003
CN 2551656 Y 5/2003
(Continued)

*Primary Examiner* — Scott R Kastler
(74) *Attorney, Agent, or Firm* — Rothwell, Figg, Ernst & Manbeck, P.C.

(57) ABSTRACT

A carburizing device includes a furnace body that performs heat treatment on a treatment object to perform carburization treatment on the treatment object, in which: a heater configured to perform heat treatment on the treatment object is provided upright in a vertical direction within the furnace body; a gas supply section configured to supply a gas for burnout toward the heater is provided at a lower end part of the heater; the heater is inserted through a protective tube provided upright in the vertical direction; and the gas supply section is configured to supply the gas for burnout to between the protective tube and the heater.

7 Claims, 3 Drawing Sheets

(51) Int. Cl.

| | |
|---|---|
| ***C21D 9/00*** | (2006.01) |
| ***F27D 7/06*** | (2006.01) |
| ***F27B 5/04*** | (2006.01) |
| ***F27B 5/06*** | (2006.01) |
| ***F27B 5/14*** | (2006.01) |
| ***F27D 7/04*** | (2006.01) |
| *C21D 1/06* | (2006.01) |

(56) References Cited

U.S. PATENT DOCUMENTS

| | | | | |
|---|---|---|---|---|
| 6,159,306 | A * | 12/2000 | Barbour | C23C 8/22 148/225 |
| 6,258,179 | B1 | 7/2001 | Takayama et al. | |
| 2012/0230459 | A1 | 9/2012 | Elshaik | |
| 2016/0348969 | A1* | 12/2016 | Katsumata | C21D 1/773 |
| 2017/0022596 | A1* | 1/2017 | Katsumata | C21D 9/0006 |

FOREIGN PATENT DOCUMENTS

| | | | |
|---|---|---|---|
| CN | 201280588 | Y | 7/2009 |
| CN | 201811590 | U | 4/2011 |
| CN | 205014845 | U | 2/2016 |
| JP | 58-62414 | A | 4/1983 |
| JP | 58-189318 | A | 11/1983 |
| JP | 59-69963 | U | 5/1984 |
| JP | 2-115327 | A | 4/1990 |
| JP | 7-248193 | A | 9/1995 |
| JP | 11-117059 | A | 4/1999 |
| JP | 2006-112762 | A | 4/2006 |
| JP | 2006-112770 | A | 4/2006 |
| JP | 4605718 | B2 | 1/2011 |
| JP | 5041723 | B2 | 10/2012 |
| JP | 2013-33631 | A | 2/2013 |

* cited by examiner

CARBURIZING DEVICE

This application is a continuation application based on a PCT Patent Application No. PCT/JP2015/068983, filed on Jul. 1, 2015, whose priority is claimed on Japanese Patent Application No. 2014-149915, filed on Jul. 23, 2014. The contents of both the PCT Application and the Japanese Application are incorporated herein by reference.

TECHNICAL FIELD

Embodiments described herein relates to a carburizing device.

BACKGROUND ART

As a carburizing device that heats a metal material, which is a treatment object, to perform carburization treatment on the treatment object, a vacuum carburizing furnace is known (for example, refer to Patent Documents 1 and 2).

A vacuum carburizing furnace is an apparatus that performs vacuum carburization treatment using hydrocarbon-based gas (carburizing gas) at high temperature and reduced pressure, and the vacuum carburization treatment is treatment in which carburization is caused by decomposing hydrocarbon-based gas into carbon and hydrogen and making a carbon component react on the surface of steel.

In such vacuum carburization treatment, hydrocarbon-based gas is decomposed into carbon and hydrogen at high temperature and reduced pressure, and also a polymerization reaction that forms polymeric substances may be caused. Additionally, the decomposed carbon may cause sooting. If products such as polymeric substances or soot adheres to and is deposited on the inside of the furnace, particularly on the surface of a heater as a heating source, the heating function of the heater degrades, and excellent carburization treatment cannot be performed. As a result, excessive energy, time, and the like are required for the carburization treatment.

In the related art, Patent Document 1 discloses that, in order to prevent such degradation of adiabatic performance, an operation termed burnout of introducing air into the furnace to burn products such as soot is performed.

Additionally, Patent Document 2 discloses that products such as polymeric substances or soot are prevented from adhering to the surface of an electric heater as a heat source by covering the electric heater with a radiant tube made of a ceramic.

Additionally, Patent Documents 3 to 5 disclose a heat-treating furnace and a heating type furnace that have a heater installed in a protective tube.

CITATION LIST

Patent Documents

Patent Document 1: Japanese Unexamined Patent Application, First Publication No. H2-115327

Patent Document 2: Japanese Unexamined Patent Application, First Publication No. 2006-112770

Patent Document 3: Japanese Unexamined Patent Application, First Publication No. 2006-112762

Patent Document 4: Japanese Patent No. 5041723

Patent Document 5: Japanese Unexamined Patent Application, First Publication No. H7-248193

SUMMARY

However, merely by arranging a heater so as to be inserted through a tube, hydrocarbon-based gas or its products may flow in the tube from an opening of the tube, and products such as polymeric substances or soot may adhere to the surface of the heater. If the above products adhere to the surface of the heater in this way, particularly in a case where the heater is arranged so as to be inserted into the tube, burnout for the heater becomes difficult.

This disclosure has been made in view of the above circumstances, and an object thereof is to provide a carburizing device that facilitates burnout for a heater.

A first aspect of this disclosure is a carburizing device including a furnace body that performs heat treatment on a treatment object to perform carburization treatment on the treatment object, in which: a heater configured to perform heat treatment on the treatment object is provided upright in a vertical direction within the furnace body; a gas supply section configured to supply a gas for burnout toward the heater is provided at a lower end part of the heater; the heater is inserted through a protective tube provided upright in the vertical direction; and the gas supply section is configured to supply the gas for burnout to between the protective tube and the heater.

According to the carburizing device related to this disclosure, the heater for performing heat treatment on the treatment object is inserted through the protective tube provided upright in the vertical direction within the furnace body, and the gas supply section supplies gas for burnout to between the protective tube and the heater. Therefore, the burnout for removing dirt on the heater can be implemented separately from the burnout within the treatment chamber by the heater being accommodated within the protective tube separated from the treatment chamber within the furnace body. Therefore, this can contribute to improvement in operational rate.

DESCRIPTION OF EMBODIMENTS

Hereinafter, this disclosure will be described below with reference to the drawings. In addition, in the following drawings, scales of respective members are appropriately changed in order to make the respective members have recognizable sizes.

Figure 1:
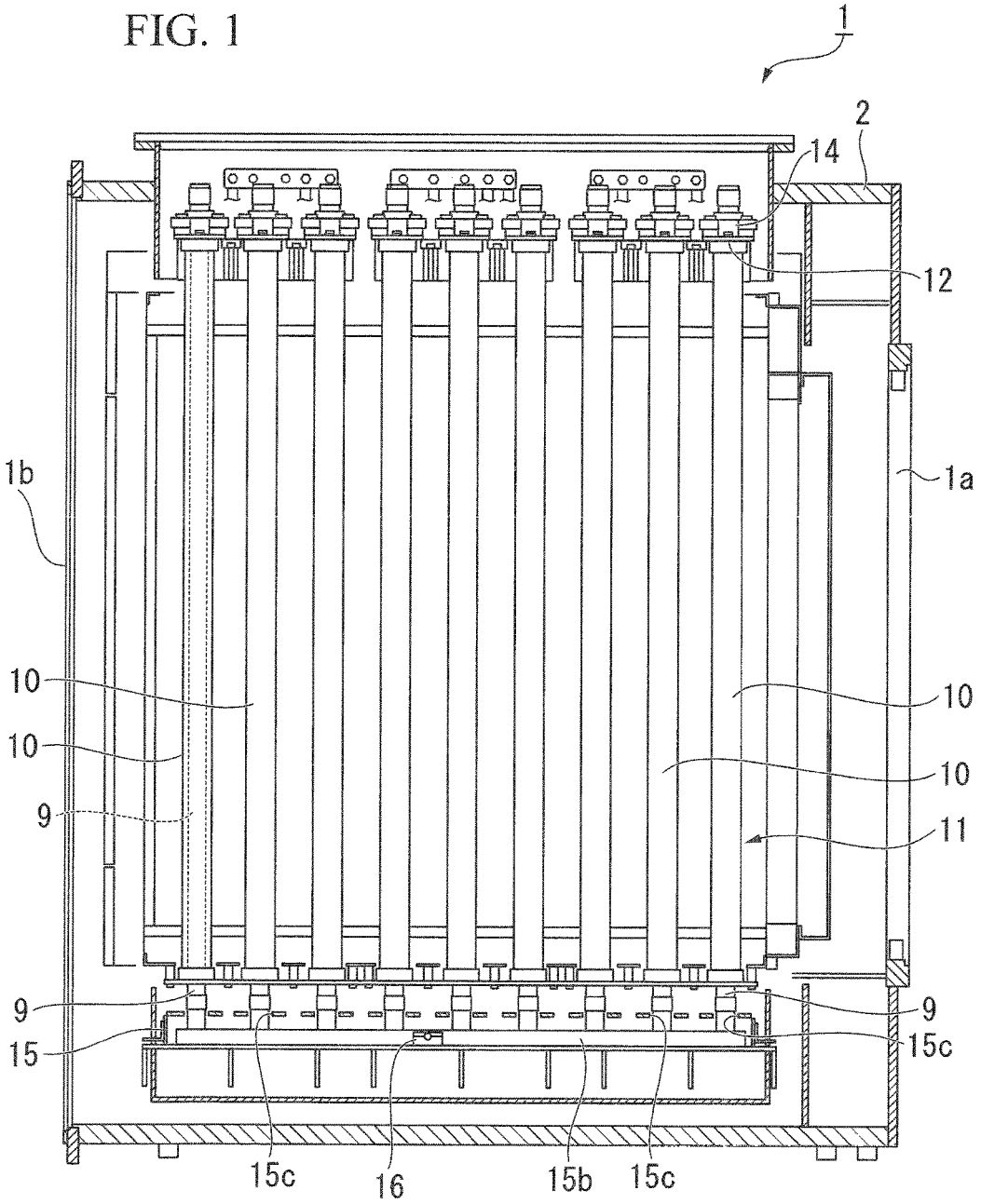
FIG. 1 is a longitudinal sectional view as seen from the front illustrating a schematic configuration of an embodiment of a carburizing device related to this disclosure.
Figure 2:
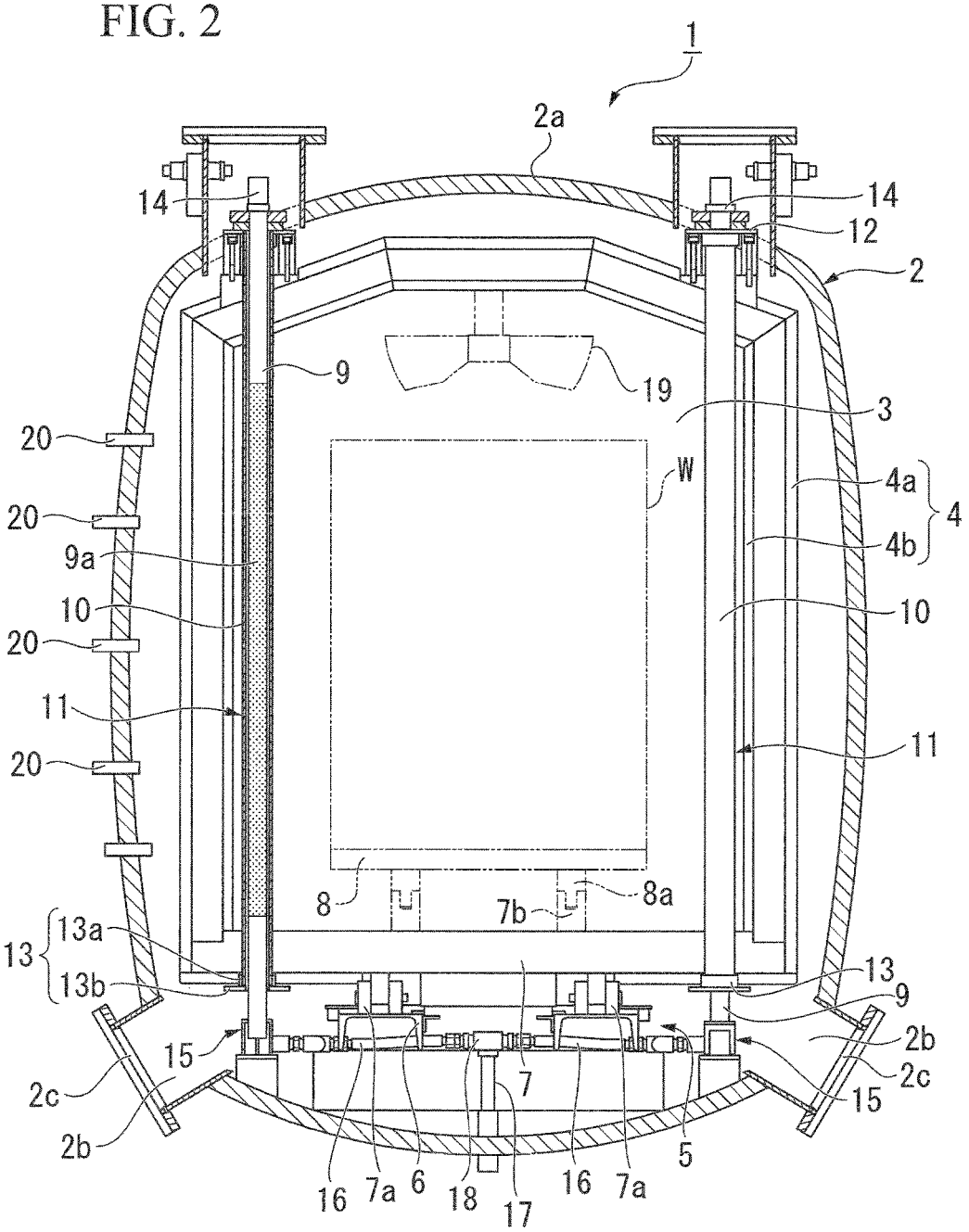
FIG. 2 is a longitudinal sectional view as seen from a side illustrating a schematic configuration of the embodiment of the carburizing device related to this disclosure.

FIGS. 1 and 2 are views illustrating a schematic configuration of an embodiment of a carburizing device related to this disclosure. FIG. 1 is a longitudinal sectional view as seen from the front, and FIG. 2 is a longitudinal sectional view as seen from a side.

In FIGS. 1 and 2, reference sign 1 designates a carburizing device. The carburizing device 1 is a vacuum carburizing furnace that performs heat treatment on a treatment object W to perform vacuum carburization treatment on the treatment object W, and constitutes a portion of a continuous vacuum carburizing furnace. The continuous vacuum carburizing furnace includes the vacuum carburizing furnace (carburizing device 1) and a cooling device, continuously transfers the treatment object W after the vacuum carburization treatment to the cooling device, and performs cooling treatment on the treatment object W.

As illustrated in FIG. 1, the carburizing device 1 has a door part 1*a* at one side part, and a door part 1*b* at the other side part. The door part 1*a* leads to a carrying-in chamber (not illustrated) for carrying the treatment object W into the carburizing device 1, and the door part 1*b* leads to a cooling chamber (not illustrated) configured to cool the treatment object W.

The carburizing device 1 includes a furnace body 2 having a substantially rectangular parallelepiped shape, and as illustrated in FIG. 2, a treatment chamber 3 disposed within the furnace body 2 and configured to perform carburization treatment. The treatment chamber 3 is surrounded by a heat-insulating layer 4 formed by an external heat-insulating material 4*a* and an internal heat-insulating material 4*b* having predetermined adiabatic performance, and a hearth 5 is provided below the treatment chamber 3. A plurality of rails 6 configured to support and transfer the treatment object W are provided on the hearth 5.

A conveyance plate 7 is movably placed on the rails 6, and a tray 8 is placed on the conveyance plate 7. A plurality of rollers 7*a* traveling along the rails 6 are provided on a lower surface of the conveyance plate 7. Additionally, a support member 7*b* is provided on an upper surface of the conveyance plate 7, and an engagement leg 8*a* detachably engaged with the support member 7*b* is provided on a lower surface of the tray 8. By virtue of such a configuration, the tray 8 is placed on and supported by the conveyance plate 7 via the engagement leg 8*a* and the support member 7*b*.

The treatment object W made of a metal material is placed on the tray 8, and the treatment object W is subjected to carburization treatment within the treatment chamber 3. Here, the tray 8 is formed in a lattice or in a mesh so as not to hinder contact of carburizing gas (hydrocarbon-based gas) with the treatment object W.

Heaters 9 are arranged on a front side and a back side of the furnace body 2. Each heater 9, as illustrated in FIG. 2 has an elongated columnar shape that is arranged upright in a vertical direction, and most of the heater 9 in its length direction is arranged within the treatment chamber 3. A heat generator 9*a* of the heater 9 that generates heat as electricity flows to the heat generator 9*a* is arranged so as to be located within the treatment chamber 3. Accordingly, the heaters 9 favorably heat the inside of the treatment chamber 3, and heats the treatment object W within the treatment chamber 3 to perform carburization treatment on the treatment object W as will be described below. Wirings (not illustrated) are connected to an upper end part and a lower end part of the heater 9, and power is supplied to the heater 9 via the wirings. In addition, an opening 2*b* used for performing various kinds of operation, such as pulling out the wirings connected to the lower end parts of the heaters 9, is formed at a lower part of the furnace body 2, and a lid 2*c* is openably and closably attached to the opening 2*b*.

In the present embodiment, the heater 9 is inserted through a protective tube 10 provided upright in the vertical direction. The protective tube 10 is made of a ceramic, such as alumina, and the internal diameter of the protective tube 10 is made greater than the external diameter of the heater 9. The heater 9 is inserted through the protective tube 10 such that a central axis of the heater 9 coincides with a central axis of the protective tube 10, and is thereby arranged such that an outer peripheral surface of the heater 9 does not touch an inner peripheral surface of the protective tube 10. Therefore, a flow passage through which air (gas) for burnout flows favorably as will be described below is formed between the protective tubes 10 and the heater 9.

As illustrated in FIG. 1, a plurality of the heaters 9 are arranged to be aligned in a horizontal direction, that is, from the one door part 1*a* side to the other door part 1*b* side, and thereby form a heater row 11. As illustrated in FIG. 2, in the present embodiment, a total of two heater rows 11 are arranged so that one row is arranged on the front side of the furnace body 2 and the other row is arranged on the back side of the furnace body 2.

Figure 3:
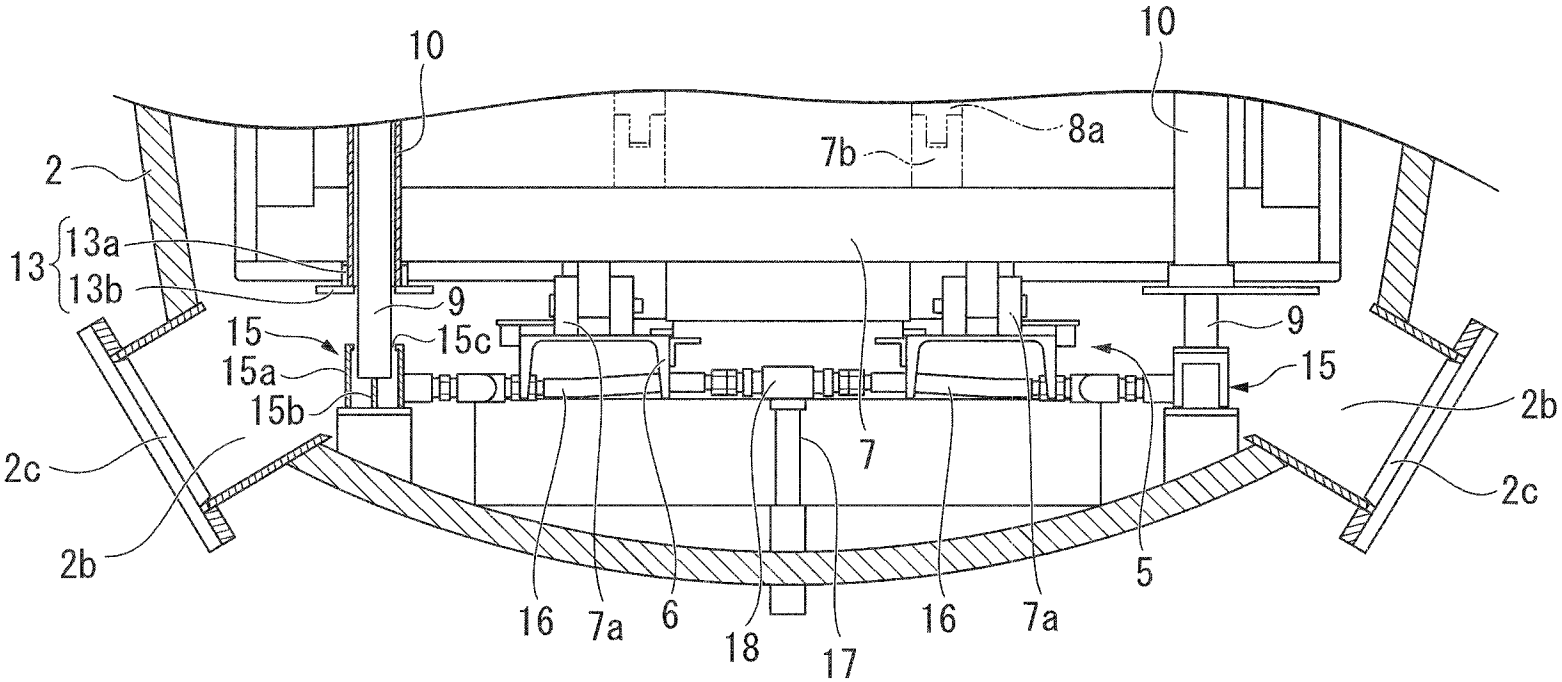
FIG. 3 is an enlarged view of main parts of FIG. 2.

An upper protective tube receptacle 12 is provided at an upper end part of the protective tube 10. By attaching and fixing the upper protective tube receptacle 12 to a ceiling part 2*a* of the furnace body 2, the upper end part of the protective tube 10 is fixed to the ceiling part 2*a* of the furnace body 2. A lower end part of the protective tube 10 is supported by and fixed to a lower protective tube receptacle 13 attached to a bottom part of the heat-insulating layer 4 that forms the treatment chamber 3, as illustrated in FIG. 3 that is an enlarged view of main parts of FIG. 2.

The lower protective tube receptacle 13 is formed by a cylindrical part 13*a* that passes through the bottom part of the heat-insulating layer 4, and an annular plate-shaped flange part 13*b* that is provided at a lower end of the cylindrical part 13*a* and is made to abut against a bottom surface of the heat-insulating layer 4. The internal diameter of the flange part 13*b* is made smaller than the internal diameter of the cylindrical part 13*a*. By virtue of such a configuration, the lower end part of the protective tube 10 is inserted through the cylindrical part 13*a* of the lower protective tube receptacle 13, and the lower end part of the protective tube 10 is supported by an inner peripheral edge part of the flange part 13*b*. Here, the internal diameter of the flange part 13*b* is made greater than the external diameter of the heater 9. Accordingly, air (gas) for burnout favorably flows between the heater 9 and the inner peripheral edge of the flange part 13*b* as will be described below.

The upper end part of the heater 9 is attached to an upper end opening of the protective tube 10 by a holding member 14. The holding member 14 is attached to the upper end opening of the protective tube 10, leaving opening area with sufficient size, without blocking the upper end opening of the protective tube 10. Additionally, the heater 9 is formed and arranged such that a lower end side of the heater 9 extends under the protective tube 10, and the lower end of the heater 9 is received and supported by a receiving member 15 arranged below the protective tube 10.

The receiving member 15 constitutes a gas supply section in this disclosure, and has a tubular body 15*a* that has a rectangular tubular shape and extends in the horizontal direction as illustrated in FIG. 1, and a rib plate 15*b* that is provided within the tubular body 15*a* and extends in a length direction of the tubular body 15*a*. The tubular body 15*a* is arranged in a row direction of the heater row 11, and a plurality of openings 15*c* that allow the lower end parts of the heaters 9 to pass therethrough are formed in an upper surface of the tubular body 15*a*. The opening diameter (internal diameter) of the opening 15*c*, similar to the flange part 13*b*, is made greater than the external diameter of the heater 9, and thereby air (gas) for burnout favorably flows through the inside of the opening 15*c*. In addition, both end parts of the tubular body 15*a* are blocked without opening.

The rib plate 15*b* is a thin plate that has a height (width) of about half of the height of the tubular body 15*a* in the vertical direction, and supports the lower ends of the heaters 9 by an upper end of the rib plate 15*b*. That is, the rib plate 15*b*, as illustrated in FIG. 3, is arranged so as to correspond to centerlines of lower end surfaces of the heaters 9 in order to support the centers of the lower end surfaces of the heaters 9, and thereby stably supports the heaters 9.

The receiving member 15 having the above configuration is arranged below each of the heater rows 11 arranged in two rows.

A supply pipe 16 that allows the gas for burnout to be supplied therethrough is connected to the tubular body 15*a* of the receiving member 15. The supply pipe 16 is connected to a central part of an inner surface of the tubular body 15*a* of each receiving member 15, and communicates with the inside of each tubular body 15*a*. The supply pipe 16 is substantially horizontally arranged, and is connected to an upper end part of a main pipe 17, which rises into the furnace body 2 from below the bottom part of the furnace body 2, via a branch pipe 18. The main pipe 17 is connected to a pneumatic power source (burnout gas source) arranged outside the furnace body 2, and supplies air (gas) into the receiving members 15 via the branch pipe 18 and the supply pipe 16.

The pneumatic power source, the main pipe 17, the branch pipe 18, the supply pipe 16, and the receiving members 15 constitute the gas supply section related to this disclosure that supplies air (gas) for burnout toward the heaters 9. This gas supply section is provided in a state where the gas supply section is connected to the lower end parts of the heaters 9. The air delivered from the pneumatic power source passes through the main pipe 17, the branch pipe 18, the supply pipe 16, and the receiving members 15, and rises in the length direction of the heaters 9 from the openings 15*c* of the receiving members 15.

In that case, as the air that has flown out of the opening 15*c* of the receiving member 15 rises in the length direction of the heater 9 as illustrated in FIG. 2, the air flows into a gap between the protective tube 10 and a tube of the heater 9, and rises in the length direction of the heater 9 as it is.

As the air that has flown into the receiving member 15 from the supply pipe 16 collides against the rib plate 15*b*, the air spreads in the length direction of the rib plate 15*b*, that is, in the horizontal direction, flows out of each of the plurality of openings 15*c*, and rises.

Additionally, the furnace body 2 is also provided with an air supply pipe (not illustrated) for mainly performing burnout treatment on an inner surface of the heat-insulating layer 4 or an outer peripheral surface of the protective tube 10 within the treatment chamber 3.

Additionally, the ceiling part 2*a* of the furnace body 2 is provided with one or a plurality of carburizing gas supply lines (not illustrated) for supplying carburizing gas (hydrocarbon-based gas), such as acetylene-based gas. A tip end of the carburizing gas supply line opens to the inside of the treatment chamber 3 and a rear end of the carburizing gas supply line is connected to a carburizing gas supply source (not illustrated). The carburizing gas supply source discharges carburizing gas at a predetermined flow rate to the carburizing gas supply line. Accordingly, the carburizing gas whose flow rate is set by the carburizing gas supply source is supplied into the treatment chamber 3.

The furnace body 2 is provided with an exhaust pipe (not illustrated) that allows the gas (such as carburizing gas or thermally-decomposed gas in which carburizing gas is thermally decomposed) within the treatment chamber 3 to be exhausted to the outside of the treatment chamber 3. An exhaust pump (not illustrated) is connected to the exhaust pipe, and the gas within the treatment chamber 3 is exhausted to the outside of the furnace body 2 by the operation of this exhaust pump.

A stirring blade 19 is arranged at the ceiling part 2*a* of the furnace body 2. The stirring blade 19 stirs the gas within the treatment chamber 3 by being rotationally driven by a motor (not illustrated). Note that the installation of the stirring blade 19 may be omitted.

A plurality of thermocouples 20 are discretely arranged in the furnace body 2 so as to surround the treatment object W within the treatment chamber 3. The thermocouples 20 detect the ambient temperature within the treatment chamber 3 that is the same as the surface temperature of the treatment object W, and outputs the detection results to a control unit (not illustrated).

In order to perform carburization treatment with the carburizing device 1, the treatment object W is first carried into the treatment chamber 3 within the furnace body 2 from the carrying-in chamber (not illustrated) in a state where the treatment object W is placed on the tray 8. Then, if the treatment object W is set at a predetermined position on the hearth 5, the exhaust pump is actuated to exhaust the air within the treatment chamber 3 to the outside and reduce the pressure of the atmosphere within the treatment chamber 3 (the surrounding atmosphere of the treatment object W) until a predetermined vacuum state (pressure state) is brought about.

In parallel with the pressure reduction or after the pressure reduction, the heaters 9 are energized to heat the inside of the treatment chamber 3 and the treatment object W. In that case, by heating the inside of the treatment chamber 3, that is, the surface temperature of the treatment object W, on the basis of the detection results of the thermocouples 20, the surface temperature of the treatment object W rises gradually over a given time in a pressure environment with a given temperature, and is made to reach a carburization temperature.

Then, if the surface temperature of the treatment object W is made to reach the carburization temperature and is stabilized at this carburization temperature, a predetermined flow rate of carburizing gas of is continuously introduced into the treatment chamber 3. Furthermore, the gas within the treatment chamber 3 is exhausted from the exhaust pipe to the outside by actuating the exhaust pump.

The degree of vacuum (pressure) within the treatment chamber 3 is kept at a predetermined pressure (carburization pressure) by performing introduction of the carburizing gas and exhaust of the gas using the exhaust pump in parallel. That is, the pressure within the treatment chamber 3 is kept at a desired carburization pressure by the amount of introduction of the carburizing gas continuously introduced into the treatment chamber 3 being balanced with the amount of discharge of the gas from the exhaust pipe.

Then, as the maintenance state of carburization pressure continues over a predetermined time (carburizing time), carbon atoms (C) generated by thermally decomposing carburizing gas gradually enter the inside of the treatment object W from the surface of the treatment object W. As a result, a carburizing layer with a predetermined depth (carburizing depth) is formed in the vicinity of the surface of the treatment object W.

If such carburization treatment is performed, carburizing gas is decomposed into carbon and hydrogen at high temperature and reduced pressure, and also a polymerization reaction that forms polymeric substances may be caused. Additionally, the decomposed carbon may cause sooting. Then, although such polymeric substances or soot on the heater 9 side mostly adheres to the outer peripheral surface of the protective tube 10 to which the heater 9 is externally fitted, the polymeric substances or soot partially flows in from a lower end opening of the protective tube 10 or the like and adheres to the outer peripheral surface of the heater 9.

If carburization treatment is performed for a preset time in this way, the supply of the carburizing gas is stopped and the heating using the heaters 9 is also stopped. Then, the pressure reduction using the exhaust pump is also stopped, and the treatment object W is carried out from the inside of the treatment chamber 3 in a state where the treatment object W is placed on the tray 8. Thereafter, carburization treatment is performed on a new treatment object W again by carrying in the new treatment object W into the treatment chamber 3 and repeating the above operations.

If the number of times of carburization treatment on the treatment object W is repeated and lots of the polymeric substances or soot adhere to and are deposited on the surface of the heater 9 or the inside of the treatment chamber 3, burnout is performed. In that case, in the present embodiment, since the gas supply section for supplying air particularly toward the heater 9 is provided, air is made to flow from the lower side of the heater 9 toward the upper side of the heater 9 via the receiving member 15. Therefore, burnout treatment can be easily and effectively performed on the heater 9 arranged upright within the protective tube 10, and burnout for the heater 9 can be implemented apart from the burnout for the inside of the treatment chamber 3.

That is, in the carburizing device 1 of the present embodiment, the air introduced from the main pipe 17 can be supplied to the receiving members 15 via the branch pipe 18 and the supply pipe 16, and can be made to rise within the protective tubes 10 along the outer peripheral surfaces of the heaters 9 from the receiving members 15. Then, the air that has risen along the heater 9 flows in from the gap between the heater 9 and the protective tube 10 located immediately above the opening 15*c* of the receiving member 15, rises as it is, flows out of the upper protective tube receptacle 12 side, and is discharged to the outside of the furnace body 2.

The air that flows into the protective tube 10 in this way is heated by the residual heat of the heater 9 or the like, thereby forming an ascending current to reliably flow through the inside of the protective tube 10, and is brought into contact with the outer peripheral surface of the heater 9, thereby reliably performing burnout of the above polymeric substances or soot adhering to the outer peripheral surface of the heater 9.

Hence, according to the carburizing device 1 of the present embodiment, the burnout of removing dirt of the heater 9 can be implemented apart from the burnout within the treatment chamber 3 by storing the heater 9 within the protective tube 10 separated from the treatment chamber 3 within the furnace body 2. Therefore, this can contribute to improvement in operational rate.

The gas supply section includes the receiving member 15 that is arranged below the lower end openings of the protective tubes 10 to receive the lower ends of the protective tubes 10, and the supply pipe 16 that allows gas for burnout to be supplied therethrough into the receiving member 15. Therefore, the air supplied by the supply pipe 16 can be made to flow toward the plurality of heaters 9 by the receiving member 15. Therefore, the gas supply section can be relatively efficiently arranged at the bottom part of the furnace body 2 where various constituent members are arranged and extra space is little.

Additionally, the plurality of heaters 9 are arranged so as to be aligned in the horizontal direction to form the heater row 11, and one tubular body 15*a* of the receiving member 15 is arranged for one heater row 11. Therefore, as mentioned above, the gas supply section can be relatively efficiently arranged at the bottom part of the furnace body 2.

Additionally, as a plurality of (two) the heater rows 11 are provided, the inside of the treatment chamber 3 can be uniformly heated, and carburization treatment can be favorably performed.

Additionally, the rib plate 15*b* is provided within the tubular body 15*a* of the receiving member 15 so as to extend in the length direction of the tubular body 15*a*, and the lower ends of the heaters 9 are supported by the rib plate 15*b*. Therefore, the air that has flown into the receiving member 15 from the supply pipe 16 can spread in the length direction of the rib plate 15*b* (in the horizontal direction) by making the air collide against the rib plate 15*b*, and then the air can be made to flow out of each of the plurality of openings 15*c* and rise toward the heaters 9. Accordingly, burnout treatment of the plurality of heaters 9 can be favorably performed with a simple configuration.

In addition, the carburizing device of this disclosure is not limited to the above embodiment, and various changes can be made without departing from the scope of this disclosure.

For example, the configuration of the furnace body 2, the configuration of the treatment chamber 3, and a mechanism for conveying the treatment object W are not limited to the above embodiment, and various configurations can be adopted.

Additionally, the number of heaters 9 or the arrangement (array) of the heaters 9 is not limited to the above embodiment, and various forms can also be adopted.

Moreover, the gas supply section for supplying air (gas for burnout) to the lower end parts of the heaters 9 is not limited to the above embodiment, and various forms can also be adopted.

INDUSTRIAL APPLICABILITY

According to the carburizing device related to this disclosure, the burnout of removing dirt of the heater can be implemented apart from the burnout within the heat treatment chamber by the heater being accommodated within the protective tube separated from the heat treatment chamber within the furnace body, and this can contribute to improvement in operational rate.

What is claimed is:

1. A carburizing device comprising:

a furnace body that performs heat treatment on a treatment object to perform carburization treatment on the treatment object;

a first heater configured to perform heat treatment on the treatment object, wherein the first heater is provided upright extending in a vertical direction within the furnace body;

a gas supply section configured to supply a gas toward the first heater, wherein the gas supply section is provided at a lower end part of the first heater; and a protective tube provided upright extending in the vertical direction within the furnace body, wherein the first heater is inserted into the protective tube, wherein the gas supply section is connected to a burnout gas source, and wherein the gas supply section is configured to supply the gas toward the first heater to perform a burnout operation which burns products formed during the carburization treatment between an outer peripheral surface of the first heater and an inner peripheral surface of the protective tube.

2. The carburizing device according to claim 1, wherein the gas supply section includes a receiving member that is arranged below a lower end opening of the protective tube and receives a lower end of the protective tube, and a supply pipe that is configured to supply the gas for the burnout operation into the receiving member.

3. The carburizing device according to claim 2, further comprising:

a second heater arranged such that the second heater is aligned with the first heater to form a heater row, wherein the heater row extends in a horizontal direction; and the receiving member includes a tubular body that extends in the horizontal direction, and the tubular body receives the heater row.

4. The carburizing device according to claim 1, wherein the gas supply section includes a tubular body which is arranged below a lower end opening of the protective tube and to which the gas is supplied, wherein the tubular body includes an opening in an upper surface of the tubular body, and the lower end part of the first heater passes through the opening of the tubular body.

5. The carburizing device according to claim 2, wherein the receiving member includes a tubular body which has a rectangular tubular shape and which extends in a horizontal direction, wherein a rib plate is provided within the tubular body, and wherein the rib plate extends in a length direction of the tubular body and supports a lower end of the first heater.

6. The carburizing device according to claim 1, further comprising:

a heat-insulating layer that forms a treatment chamber disposed within the furnace body; and a lower protective tube receptacle, wherein an upper end part of the protective tube is fixed to a ceiling part of the furnace body, wherein a lower end part of the protective tube is supported by and fixed to the lower protective tube receptacle, and wherein the lower protective tube receptacle is attached to a bottom part of the heat-insulating layer.

7. The carburizing device according to claim 6, wherein an upper end part of the first heater is attached to an upper end opening of the protective tube by a holding member, and wherein a lower end of the first heater extends under the protective tube.

* * * * *